United States Patent [19]

Sandrone et al.

[11] 4,147,438

[45] Apr. 3, 1979

[54] SERIAL PRINTER FOR TYPEWRITERS, TELEPRINTERS AND DATA PROCESSORS

[75] Inventors: Bruno Sandrone, Ivrea; Giuseppe Nuccio, Candia Canavese; Emilio Gilardi, Caluso, all of Italy

[73] Assignee: Ing C. Olivetti & C., S.p.A., Ivrea, Italy

[21] Appl. No.: 784,425

[22] Filed: Apr. 4, 1977

[30] Foreign Application Priority Data

Apr. 21, 1976 [IT] Italy ..... 67948 A/76

[51] Int. Cl.[2] ..... B41J 1/30

[52] U.S. Cl. ..... 400/144.2; 101/93.48; 400/166; 400/173

[58] Field of Search ..... 101/93.03, 93.48; 197/18, 53, 54, 98, 151, 154, 157, 159; 400/144.2–144.4, 166, 167, 173, 174

[56] References Cited

U.S. PATENT DOCUMENTS

| | | | |
|---|---|---|---|
| 1,110,346 | 9/1914 | Reisser | 197/53 |
| 2,127,507 | 8/1938 | Fuchs | 197/53 |
| 2,462,132 | 2/1949 | Salmon | 197/53 |
| 3,378,127 | 4/1968 | Clary et al. | 197/53 X |
| 3,651,916 | 3/1972 | Becchi | 197/54 |
| 3,740,745 | 6/1973 | Chao | 197/98 X |
| 3,840,105 | 10/1974 | Kittredge | 197/53 |
| 3,949,853 | 4/1976 | Lahr et al. | 197/53 |
| 3,983,985 | 10/1976 | Guerrini et al. | 197/53 X |
| 4,020,940 | 5/1977 | Daley et al. | 197/151 |

FOREIGN PATENT DOCUMENTS

| | | | |
|---|---|---|---|
| 2162230 | 6/1973 | Fed. Rep. of Germany | 197/1 R |

*Primary Examiner*—Paul T. Sewell

*Attorney, Agent, or Firm*—Schuyler, Birch, Swindler, McKie & Beckett

[57] ABSTRACT

A serial printer comprising a character carrier having a plurality of flexible leaf springs bearing characters on the extremities thereof. A desired character is selected by positioning the corresponding leaf spring to a printing position. A pushing mechanism exerts pressure against the leaf spring in the printing position to effect a controlled motion thereof such that the character meets the paper at a low velocity instead of from acquired kinetic energy thereby resulting in noiseless printing.

12 Claims, 20 Drawing Figures

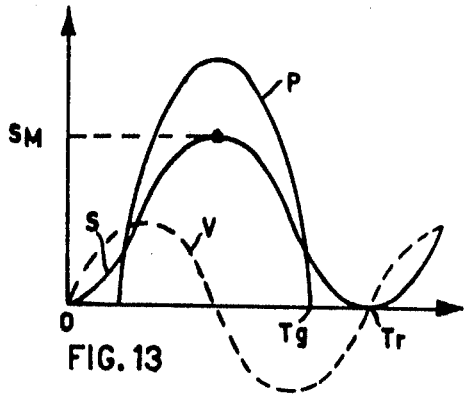
FIG. 13
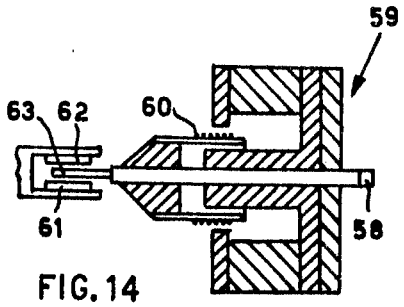
FIG. 14
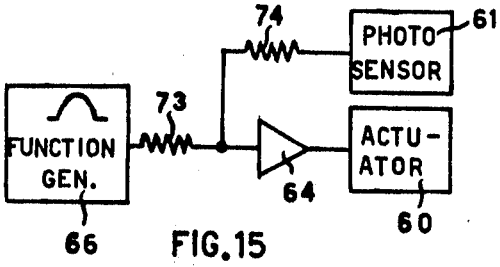
FIG. 15
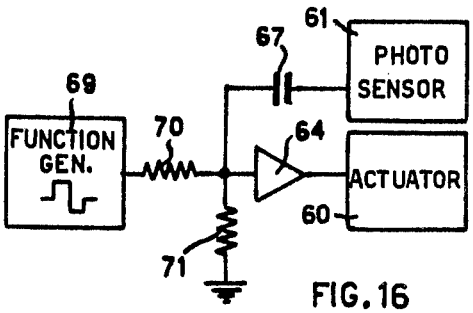
FIG. 16
FIG. 17
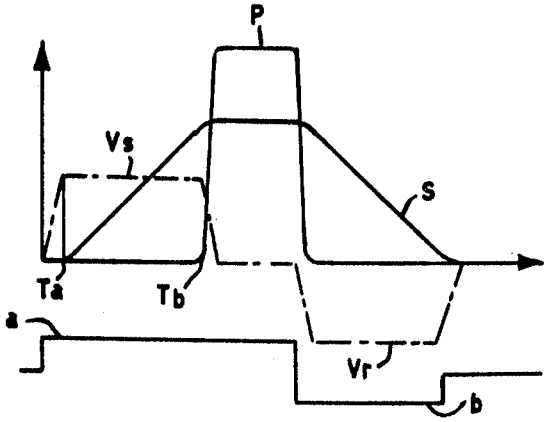

SERIAL PRINTER FOR TYPEWRITERS, TELEPRINTERS AND DATA PROCESSORS

BACKGROUND OF THE INVENTION

The present invention relates to a serial printer, particularly suited for the use in office typewriters. In the printer the printing characters are disposed on the extremities of flexible leaf springs, and provision is made of a selection mechanism positioning the character to be printed on the trajectory of a member pushing it against the paper.

In several printers known in the art as "wheel" or "chain" printers, the printing character, mounted at the extremity of a flexible leaf spring, is launched against the paper with a high velocity by an electromagnet. Because of the reduced mass of the character carrier and of the printing characters, such devices allow for a very fast positioning of the required character by means, for instance, of electronically driven step motors, reaching in this way high printing velocities. On the other hand the high velocity of the impact causes a very annoying printing noise, which is not acceptable today in a normal office environment. With such machines, to reach acceptable noise levels, it is necessary to use complex silencing enclosures, with narrow openings which besides being expensive, heavily limit the visibility and accessibility of the paper.

The produced noise is greatly reduced with the "non impact" printers, however the known types of solutions: ink-jet, thermal, electrostatic, electrochemical, etc., are not suitable for use in normal typewriters, because they are complicated and expensive, often they require the use of special papers, give a poor printing quality and do not allow the simultaneous obtaining of copies, which constitutes an indisposable requirement for normal office typewriters.

In some known typewriters of the hammer type, called "noiseless", it has been tried to reduce the noise produced by the printing by controlling the movement of the hammer in its trajectory against the paper, through the interposition of special kinematics between the key and the corresponding hammer, so that the hammer should meet the paper with a low velocity. Besides being complex and expensive, because of the multiplicity of the required mechanisms, such solutions are not very effective, because of the relevant mass and of the unavoidable play of the complex mechanism that accompanies each hammer in its run.

There are also known devices using printing balls or drums where it has been tried to reduce the printing noise by controlling the movement of the ball or of the drum against the paper, so that they meet the paper with a low velocity. Such devices have however inconveniences similar to those already indicated for the "noiseless" devices, because of the relevant mass and of the unavoidable plays of the ensemble represented by the ball or drum and by the mechanisms for their rotation and translation, that go along with them in their movement against the paper.

For the office typewriters the need is strongly felt to combine the simplicity, flexibility of use, ease of interchange of the printing characters, specific of the "wheel" and similar type printers, with the absence of noise of the non impact printers.

SUMMARY OF THE INVENTION

The main object of the present invention is to obtain a printer of the type in which the characters are mounted on the extremity of flexible leaf springs, in which the character meets the paper with a low velocity, so that the printing is noiseless.

This and other objects are obtained by the serial printer according to the present invention, comprising a character carrier where the printing characters are disposed on the extremity of flexibile leaf springs, a selection mechanism for positioning the required character in front of the printing position, and pushing means for pushing the selected printing character against the paper, wherein the pushing means are conditioned to move with a controlled motion, so that the character meets the paper at a low velocity, without impact, the printing action being caused by the pressure exerted by the pushing means against the printing character, instead of being the effect of the acquired kinetic energy, thereby resulting in noiseless printing.

BRIEF DESCRIPTION OF THE DRAWINGS

This and other objects of the invention will become evident from the disclosure, intended for exemplifying and not for limiting purposes, with the help of the accompanying drawings, where:

FIG. 13 is a diagram relating to the detail of FIG. 12;

FIG. 14 represents another variant of the detail of FIG. 4;

FIG. 15 represents a schematic circuit for the driving of the printer according to FIG. 14;

FIG. 16 represents another embodiment of the schematic circuit of FIG. 15;

FIG. 17 is a diagram relating to the schematic circuit of FIG. 16.

DETAILED DESCRIPTION OF THE PREFERRED EMBODIMENTS

The serial noiseless printer according to the present invention is particularly suited for use in electronic typewriters, however it may be equally used in teleprinters, terminals and similar printing machines.

Figure 1:
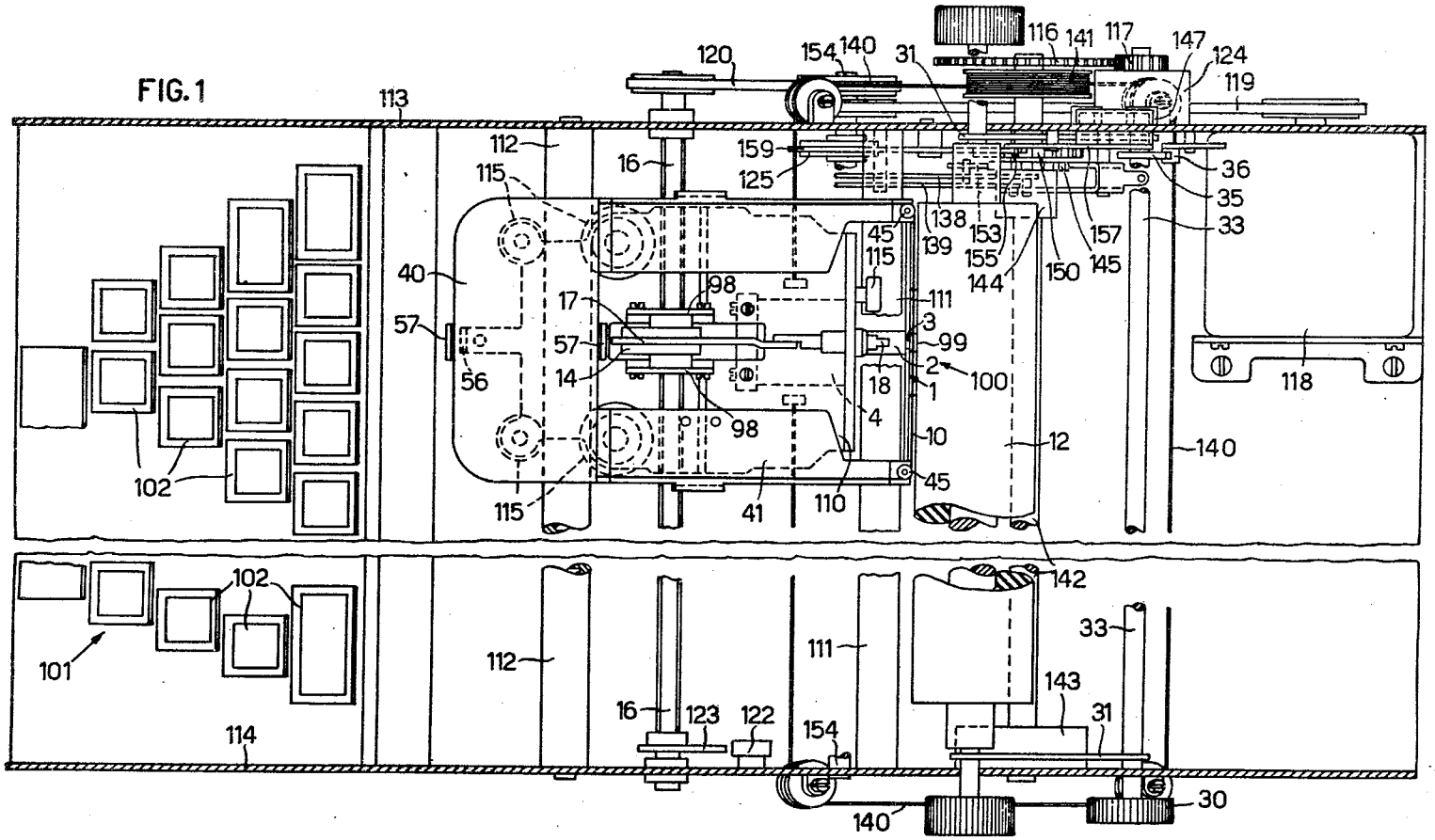
FIG. 1 is a plan view of an electronic noiseless typewriter according to the invention.
Figure 3:
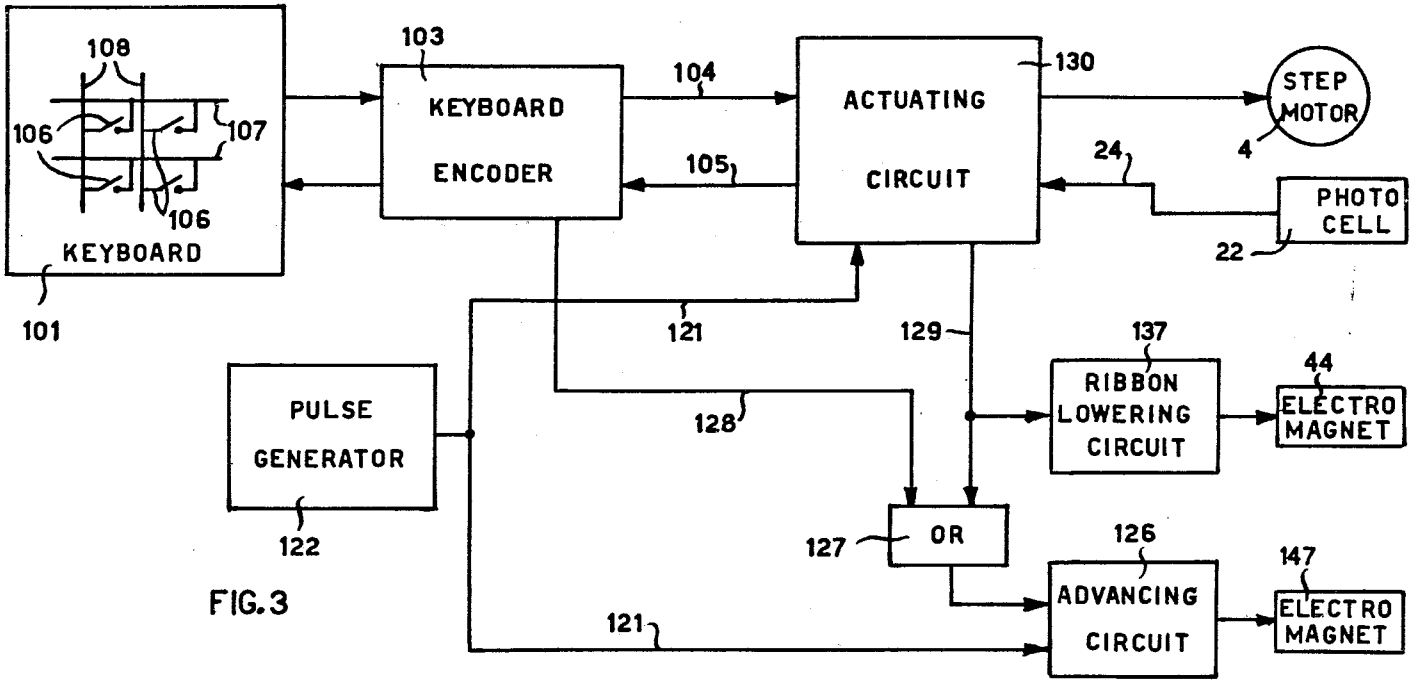
FIG. 3 is a block diagram relating to the typewriter.

In reference to FIG. 1, the typewriter comprises a printing head 1 in the form of a wheel, and an electronic keyboard 101. To each one of the keys 102 of the keyboard 101, there corresponds a contact 106, schematically indicated in FIG. 3, which closes upon the depression of the key. The armatures of the contacts 106 are interconnected in the form of a matrix by rows 107 and columns 108, according to the requirements for the connection with an encoding device commercially known as a keyboard encoder (103, FIG. 3). The keyboard encoder scans in succession, within time intervals of a few microseconds, the state of all the contacts 106 underlying to the keys 102 of the keyboard 101, associating to each position a corresponding code.

Figure 2A:
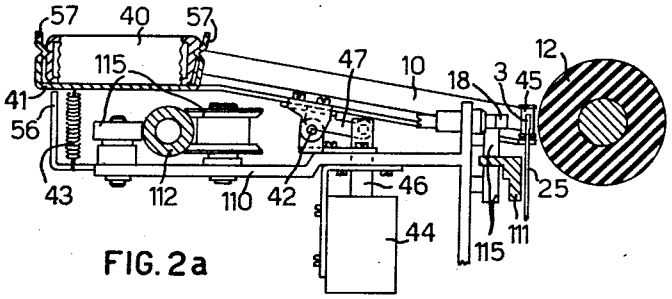
FIGS. 2 and 2*a* are lateral views, partially sectioned, of the typewriter.
Figure 2:
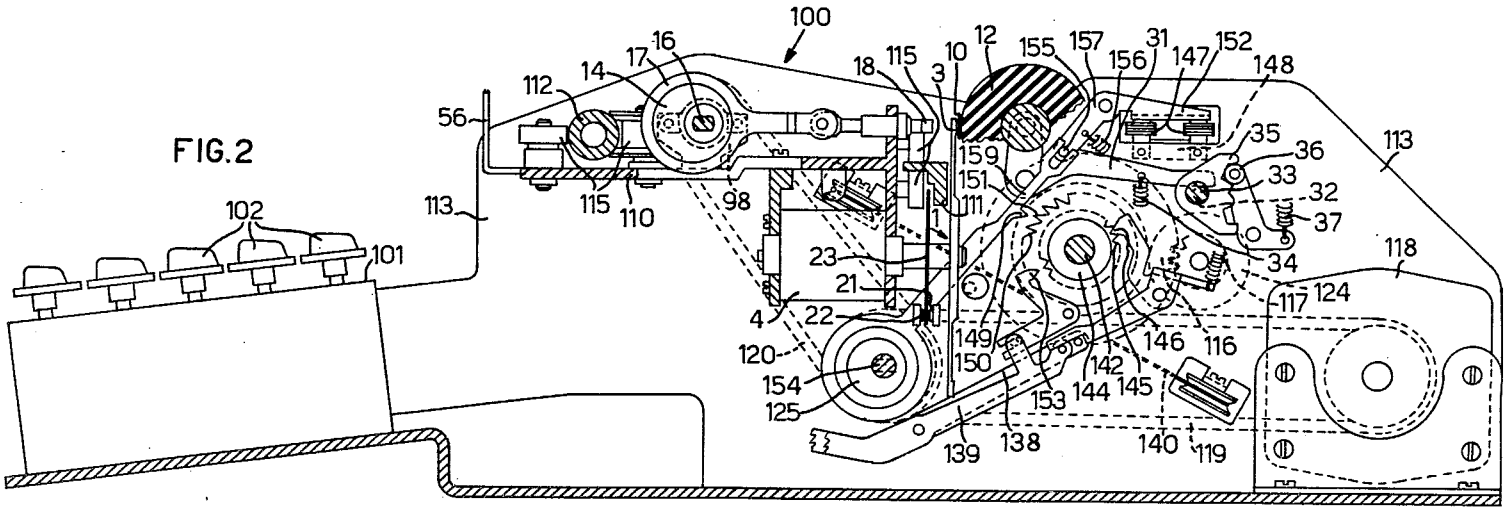

When the keyboard encoder 103 recognizes that a key 102 is depressed, it sends the corresponding code through a connection 104 to an actuating circuit 130 that determines the positioning of the type wheel 1 (FIGS. 1 and 2) of the printer 100 on the corresponding printing position. The keyboard encoder 103 has a rollover capability of several characters, so that, also in the presence of successive inputs from the keyboard, the code is maintained by the rollover memory on connection 104, until, by means of a level on connection 105, the actuating circuit 130 (FIG. 3) signals that the positioning has been completed. The keyboard encoder 103, of current production, has a rollover capacity of 8 characters, so that it can accept and memorize the successive depression of several keys, at an instantaneous velocity higher than the average velocity with which the printer is able to actuate the corresponding orders.

The printer 100 is mounted on a carriage 110 (FIG. 1), sliding with low friction as a result of rollers 115 on two guides 111 and 112 supported by the sides 113 and 114 of the typewriter, and is driven by a thin steel cable 140, in a way that will be described later. The printer 100 is schematically reproduced in FIG. 4, which shows its essential parts, which include the printing wheel 1, which carries a series of printing characters 3 on the extremity of corresponding leaf springs 25. The printing wheel 1 is easily interchangeable for the substitution of the set of the printing characters; it is, as an example, of the type indicated in the U.S. patent application Ser. No. 594,360.

The printing wheel 1 is directly mounted on a shaft 2 of positioning means 4, driven by the actuating circuit 130 (FIG. 3), that in every moment memorizes the position assumed by the printing wheel 1 and provides for the rapid rotation of said printing wheel, to position the leaf spring carrying the character 3 to be printed in front of a printing position 99 (FIG. 1) of a paper carrying platen or roller 12.

The positioning means 4 comprises a step motor, driven by actuating circuit 130 (FIG. 3) corresponding to that described in the U.S. Pat. No. 3,707,214. A sensor with a lamp 21 and a photocell 22 (FIG. 2) detects the passing of a slot in a disk 23 integral with the printing wheel 1, sending a corresponding signal back on line 24 (FIG. 3) to the actuating circuit 130, in order to insure and confirm the phasing of said wheel with the position recorded in the actuating circuit 130.

As an alternative, for the positioning means 4 it is possible to use a d.c. motor with a circuit of known type sensing the angular position of the printing wheel 1.

An eccentric 14 is disposed in front of the printing position 99, laterally guided by two flanges 98 of the carriage 110 (FIG. 1) and driven into rotation by a grooved shaft 16 extending between the sides 113 and 114 of the typewriter, in a direction parallel to that of roller 12. The grooved shaft 16 is continually driven into rotation, through timing belts 120 and 119, by an electric motor 118. The eccentric 14, through a connecting rod 17, positively reciprocates to a pushing member 18.

Figure 6:
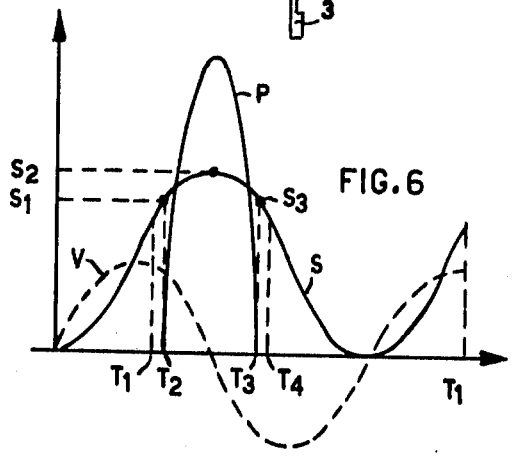
FIG. 6 is a diagram relating to the detail of FIG. 4.

For example, the grooved shaft 16 rotates with a velocity of 900 r.p.m., so that the pushing member 18 oscillates with a frequency of 15 oscillations per second with an harmonic oscillatory motion having a pair of opposite dead points where the direction of motion is reversed (curve s, FIG. 6). Differently from the known wheel printers, which are of the asynchronous type, the printer is synchronous, that is the characters are printed with a fixed preestablished rate, of 15 characters per second. The operation of the device can be understood with the help of the diagram of FIG. 6.

The trajectory s of the pushing member 18 is such that it meets the printing character 3 (FIG. 4) at time T1 (FIG. 6) while it is being decelerated by eccentric 14, and pushes it against an inked ribbon 10 and paper 11 until, at time T2, it meets the paper carrying roller 12. At the time T3 the character 3 leaves the ribbon 10 and the paper 11 and eventually, at the time T4, the pushing member 18 leaves the character 3.

The paper carrying platen or roller 12 is covered by hard rubber and the character penetrates into it, overcoming the elasticity of the hard rubber, approximately 0.3 mm deep (S1–S2, FIG. 6) in correspondence with the dead point S2. With such a penetration a good quality of print is obtained on one or two copies and for a larger number of copies an adjustment is provided for the distance of roller 12 with respect to the pushing member 18. In particular such adjustment is provided through a knob 30 (FIG. 1) and two arms 31 (FIGS. 1 and 2), carrying the roller 12, having extensions forced in eccentric grooves 32 of a shaft 33 by springs 34. A selection mechanism 35, with positioning roller 36 and spring 37, allows one to increase the distance of the roller 12 from the pushing member 18, in order to avoid too deep an incision of the first paper sheet, when a large number of copies is required.

The inked ribbon 10 is contained in a removable cartridge 40 of known type, which is kept in place by positioners 57 and is mounted on the carriage 110 by means of a supporting plate 41 (FIG. 2*a*), carrying two ribbon guides 45, for guiding the ribbon 10 in front of the printing position 99. The plate 41 is allowed to oscillate around a pivot 42, it is connected to a plunger 46 of an electromagnet 44 through an arm 47, and is pulled by a spring 43 keeping it in its normal position, against a stop 56. The plate 41 is allowed to take two different positions: the writing position, indicated in FIG. 2*a*, when the electromagnet 44 is not actuated and the non writing position, in which the ribbon 10 is lowered, so that it does not hide the printed line insuring its visibility, when the electromagnet 44 is actuated and, through the suction of the plunger 46, spaces the plate 41 apart from the stop 56. The electromagnet 44 is actuated by a circuit 137 (FIG. 3) every time that the actuating circuit 130, by means of a level on connection 129, signals that the printing wheel 1 has been positioned on a position hereinafter defined as a rest position.

A sensing device, constituted in the example by a magnetic sensor 122 mounted on the side 114 (FIG. 1), in correspondence of each revolution of the grooved shaft 16, generates an interrogation pulse on connection 121 (FIG. 3), in correspondence of the passing of an iron piece 123 (FIG. 1) protruding from the grooved shaft 16.

The interrogation pulse is generated at the time T4 (FIG. 6), when the pushing member 18, in its backward run after the printing, allows a free rotation of the printing wheel 1. Through connection 121, the interrogation pulse determines the beginning of the search operation by the actuating circuit 130 of the following character 3 to be printed, corresponding to the code present on output 104 of the keyboard encoder 103, that is of the last entered character not yet printed.

Figure 5:
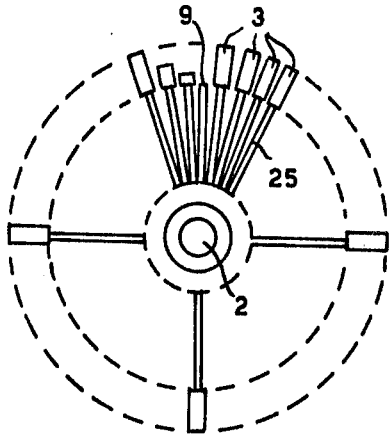
FIG. 5 is another detail of said printer.

If, in correspondence of the arrival of the interrogation pulse the rollover memory of the keyboard encoder 103 contains no entered character to be printed, a code completely formed by zeros appears on connection 104 (FIG. 3), corresponding to the angular position of the printing wheel 1 defined as rest position. In the rest position the actuating circuit 130 positions in front of the pushing member 18 a leaf spring 9 of the printing wheel 1 (FIG. 5) which carries no printing character, so that the movement of said pushing member produces no printing effect. The printing wheel 1 is shaped as indicated in FIG. 5, with the shortest characters (for instance -, ., etc.) on the leaf springs immediately to the left of the leaf spring with no printing characters, so that in the rest position the maximum visibility is allowed of the printed line.

If the printing wheel 1 is in a position different from the rest position, at the time T1 (FIG. 6) the pushing member 18 meets a printing character 3, the encounter with the paper 11 takes place at time T2 with a low and decreasing velocity v, consequently with a very low noise level, also because of the very reduced mass of the printing character 3 and of the pushing member 18 accompanying it. In the time interval T2–T3 the pushing member exerts on the printing character 3 the pressure required for the printing (curve p).

It clearly results that the printing is synchronous, although the input from the keyboard is asynchronous, because of the buffer action of the rollover memory of the keyboard encoder 103. In the case of no entered characters to be printed, the printing wheel 1 is automatically positioned in the rest position, where the pushing member 18 is allowed to follow its whole trajectory without causing any printing action, and the ribbon 10 is lowered in order to allow the visibility of the printed line.

For the correct operation of the printer according to the invention at the printing velocity of 15 characters per second, a positioning is required for the printing wheel 1 on the required printing position within 40 msec., for any sequence of characters to be printed. Such a condition is satisfied by several known positioning systems for the printing wheel, which consequently have not been described in detail.

Figure 4:
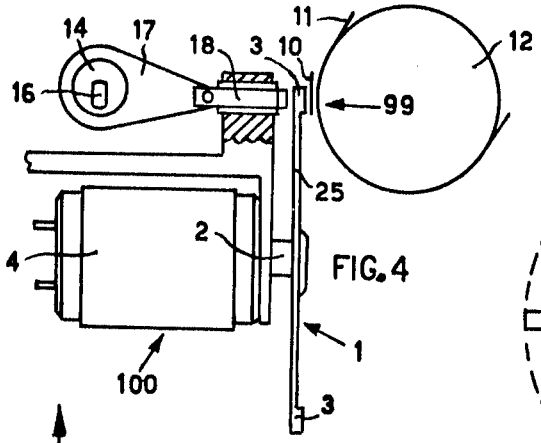
FIG. 4 is a schematic detail of the printer of FIG. 1.
Figure 7:
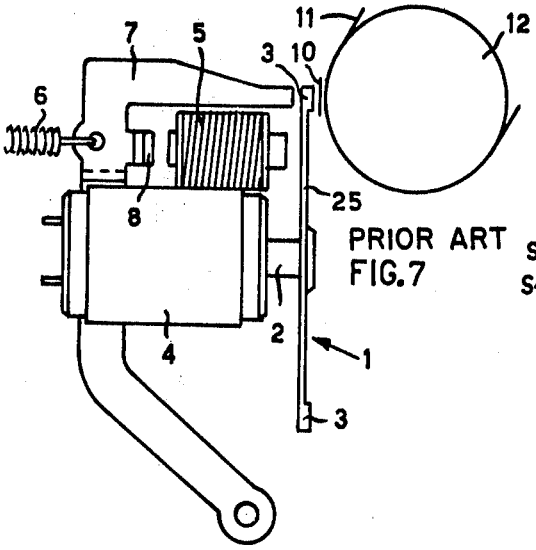
PRIOR ART FIG. 7
FIG. 7 represents a known printer of the wheel type.
Figure 8:
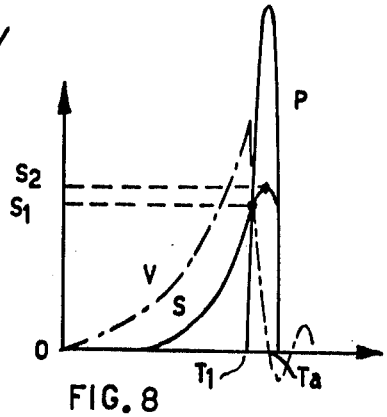
FIG. 8 PRIOR ART
FIG. 8 is a diagram relating to the printer of FIG. 7.

The advantages of the noiseless printer according to the invention are evidenced from the comparison between FIGS. 4 and 6 relating to the noiseless printer and FIGS. 7 and 8 relating to an impact printer according to the known art, also using a printing wheel 1 similar to the one of the printer according to the invention. In the impact printer of FIG. 7, once the printing wheel 1 has been positioned by the positioning member 4, an electromagnet 5 is actuated which, overcoming the action of a return spring 6, launches a hammer 7 integral with a shoe 8 against the printing character 3, deflects the leaf spring 25 constituting the spoke of the wheel and throws the printing character 3 to impact against the paper sheet 11, inserted on roller 12.

The diagram of FIG. 8 represents, in relative values, the proceeding of the printing operation in a known device like the one of FIG. 7. The origin 0 corresponds to the moment when the shoe 8 of the electromagnet 5 begins to move and T1 is the time when, pushed by hammer 7, the printing character 3 begins to press the inked ribbon 10 against the paper sheet 11. The diagram shows a very rapid increase of the velocity v up to said time T1 and thereinafter within a time Ta very close to T1 the velocity v drops to zero under the effect of the impact against the paper sheet 11 and the roller 12 sustaining it, and changes its sign because of the unavoidable bounces.

In the diagram of FIG. 8 curve s indicates the displacement in time of the hammer 7 from the rest position, until it meets the paper 11 after run S1, while S1–S2 is the useful run for the printing purposes due to the give of the inked ribbon 10, of the paper sheet 11 and of the roller 12 carrying it.

As evidenced by FIG. 8 (curve v) there is an instantaneous deceleration of the printing character 3 and of the hammer 7, whose kinetic energy is transformed into an impact force, proportional to the stopped mass, chiefly represented by the hammer 7 and the shoe 8 of electromagnet 5 integral with it.

In the diagram of FIG. 8 the impact force is represented by curve p. It is evident that such violent impact, of very short duration, produces a shock wave falling within the range of the most audible acoustic frequencies, also because of the unavoidable resonance effects due to the paper 11, to the roller 12 and to the rest of the machine.

The noise levels measured on the known impact printers are in the range of 72–78 dB and only the adoption of special closed silencing enclosures makes it possible to descend below noise levels of 70 dB. On the contrary, the noise level of the noiseless printer according to the present invention is very low, without requiring any special silencing arrangement. At a printing velocity of 15 characters per second a noise level lower than 60 dB has been measured, in the order of the background noise of a normal office environment.

In the electronic noiseless typewriter according to the present invention, also the movement of the carriage 110 carrying the printer utilizes an arrangement comprising an eccentric analogous to the one of the printer and synchronous with it.

The translation of the carriage 110 for the movements of advance and of carriage return is controlled by the thin steel cable 140 (FIG. 1) which winds up on a drum 141 integral with a shaft 142. The extremity of a precharged spiral spring contained within a coil 143, mounted on the side 114 of the typewriter, to which is also fixed the other extremity of the spiral spring, is fixed to said shaft. On the same shaft 142 is also keyed the driving member of a unidirectional clutch 144, and a rachet wheel 150. The driven section of the clutch 144 is integral with a toothed wheel 145, idle on the shaft 142. A stopping tooth 146 is normally inserted between the teeth of the toothed wheel 145, preventing the spiral spring contained in the coil 143 to unload. An advancing member 149 is provided to cooperate with the ratchet wheel.

The advancing member 149 is carried by a rod 159, which is guided through pin and slot coupling 155 by a lever 157, and is driven into continuous harmonic alternate motion by an eccentric 125, carried by shaft 154 rotating synchronously with grooved shaft 16. The lever 157 carries the shoe 152 of an electromagnet 147, whose core comprises a permanent magnet 148. In normal conditions the alternate motion of the advancing member 149 produces no effect, because the magnet 148 holds the shoe 152, preventing the advancing member 149 from engaging the teeth of the ratchet wheel 150. When however circuit 126 (FIG. 3) sends an advancing pulse in the winding of electromagnet 147, this pulse overcomes the retaining force of permanent magnet 148 on shoe 152, so that a spring 156, through the lever 157, brings the advancing member 149 to engage in its forward run, one of the teeth of the ratchet wheel 150. In this way the advancing member 149 causes the rotation of the wheel with gullett teeth 150 for an angle corresponding to the advancement of one character of the carriage 110 from left to right, further loading the spiral spring contained in coil 143. This rotation takes place in the direction allowed by unidirectional clutch 144, and has no effect on the toothed wheel 145. In its backward run the advancing member 149 glides on one back 151 of the teeth of the rachet wheel 150 and, through the pin and slot coupling 155 and the lever 157, brings the shoe 152 again within the attracting field of permanent magnet 148, to its normal position.

In consequence of the synchronism between grooved shafts 16 and 154, the motion of the advancing member 149 is synchronous with that of the pushing member 18. It follows a harmonic law, thus insuring a smooth and silent motion of the carriage 110. The phase of the eccentric 125 is such that the advancement of the carriage 110 takes place at the end of the printing phase of a character, within the time interval T4–T1 of the diagram of FIG. 6.

The advancing pulse that determines the detachment of the shoe 152 of the electromagnet 147 is generated by circuit 126 (FIG. 3) in correspondence of the pulse of interrogation on connection 121, in every case that a character has been printed, or that the advancing bar has been depressed in the keyboard 101. The presence of one of the two conditions required for the advancement is recognized by a logic circuit 127, through connections 128 with the keyboard encoder 103 and the actuating circuit 130.

It should therefore be evident that the advancement of the carriage 110 takes place only when the printing wheel 1 is in a position different from the rest position in correspondence of the advancing pulse, this meaning that a character has been printed, or when the printing wheel 1 is in the rest position and the advancing bar has been depressed. In all the other cases of printing wheel 1 in the rest position and no input from the keyboard 101, the advancing member 149 causes no displacement of the carriage 110.

For the return of the carriage 110 to the beginning of the line, the carriage return key (not shown), through a lever 138 (FIG. 2) disengages the stopping tooth 146 from the toothed wheel 145, so that the spiral spring contained in the coil 143 can unload until it carries the carriage 110 back to the beginning of the line. The backward velocity of the carriage 110 is limited by a centrifugal brake 124, connected to the drum 141 through two gears 116 and 117.

The back spacing of the carriage 100 is controlled by a key (not shown) which, through a lever 139, disengages the stopping tooth 146 from the toothed wheel 145, inserting however another tooth 153, out of phase with respect to the tooth 146 of an angle approximately corresponding to a displacement of the carriage 110 of half a character. Under the push from the spiral spring contained in coil 143, the carriage 110 goes back for one half a character space when the key is depressed, completing the full return of one character upon release of the key, when the tooth 153 disengages from the toothed wheel 145 and the stopping tooth 146 reenters in the space between teeth, successive to the one previously occupied. A device (not shown) similar to the one described for the driving of the carriage 110, allows the line feed to be determined from the keyboard 101, always deriving the motion from motor 118.

The solution described for the mechanism driving the carriage 110 is characterized by its simplicity and low cost, since it uses the same motor 118 already used for the printing. The carriage 110 of the noiseless printer according to the invention can however be driven in a different way, without departing from the scope of the invention, as an example it can be driven by means of a stepping motor or of an equivalent device, with an actuating circuit similar to the one used for positioning the printing wheel 1.

Also without departing from the scope of the invention, it is possible for instance to keep the position of the printing device 100 fixed and to move instead the paper 11 with respect to the printer.

Figure 9A:
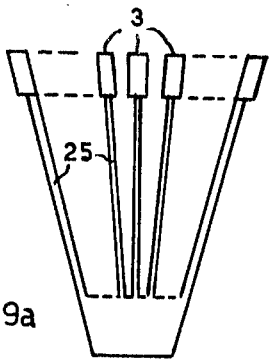
FIGS. 9*a–c* represent other embodiments of the detail of FIG. 5.

Additionally without departing from the scope of the invention, it is possible to adopt many variants for the described serial printer. In particular the printing wheel can have a different shape from that of FIG. 5, as an example it can have the shape of a truncated cone, as schematically indicated in FIG. 9*a*.

Figure 9B:
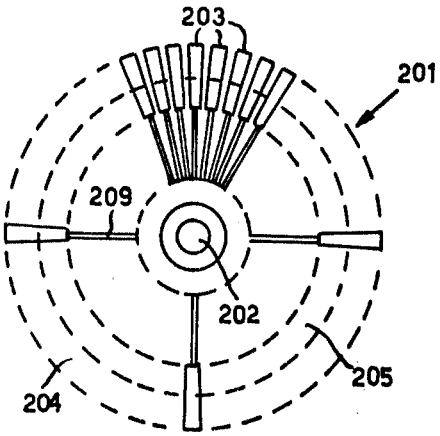

A further variant for the printing wheel 1 is represented by the wheel 201 of FIG. 9*b*, where each leaf spring 209 of the character carrier 203 carries more than one printing character, disposed on concentric rows 204, 205, which is similar to what is done in the usual hammer typewriters. It is evident that in such a solution the shaft 202 of the printing wheel 201 must be translatable in a radial direction, to allow the selection between the different character rows, by positioning it in front of the pushing member 18, without altering its angular position. This can be obtained, for example, by translating in the same time the printing wheel 201 and the positioning member 4, or as an alternative, interposing a constant angular velocity joint, for instance an Oldham joint, between the positioning member 4 and the wheel 201.

The use of a printing wheel similar to the one of FIG. 9*b* with a possibility of translation allows one to multiply the number of the printable characters or, as an alternative, to reduce the number of the angular positions to be searched and, consequently, the searching time.

It is preferable to dispose on the outmost row 204 the wide characters (for instance "m") and on the innermost row the narrow characters (for instance "!"). The use of a printing wheel with more than one row of characters like the one of FIG. 9*b* is made possible in the printer described because the velocity impressed to the characters 203 at the moment of the printing is very low, so that the deflection of the leaf spring 209 due to impact effects is practically nil. Similar printing wheels could not be used with normal impact printers of the type of FIG. 7, because the violence of the impact would excessively bend the leaf springs 209 with the character carriers 203, causing the simultaneous imprinting on the paper 11 of the characters of more than one superposed rows.

Figure 10:
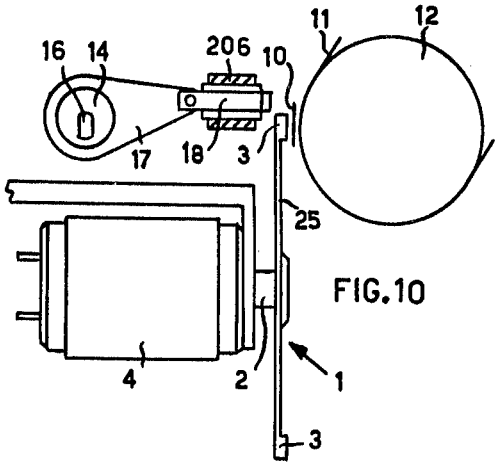
FIG. 10 represents a variant of the detail of FIG. 4.

The translation of the printing wheel can also be used, both with the wheel 1 with only one row of characters and with the wheel 201 with more than one row of characters of FIG. 9*b*, to define the rest position where the pushing member 18, meeting no printing character on its trajectory, is allowed to oscillate freely causing no printing effects. To this end the printing wheel is lowered outside the trajectory of the pushing member 18, in this way also insuring the visibility of the printed line. As an alternative, the rest position can also be defined by upward deviation of the extremity of the pushing member 18 through a displacement of a guide 206 of the member, so that it can meet no printing character, as schematically indicated in FIG. 10.

It is also possible to increase the velocity of rotation of the grooved shaft 16, and consequently the frequency of repetition of the harmonic motion of the pushing member 18, without being obliged to increase the velocity of positioning of the printing wheel. In this arrangement, for the exceptionally unfavorable conditions of positioning that occur when characters disposed on diametrically opposed positions of the printing wheel have to be printed, there is provided the possibility of accomplishing the positioning within two cycles, instead of only one cycle of oscillation of the pushing member 18, by allowing a temporary stop on an intermediate rest position at the end of the first cycle. The time loss corresponding to such an empty cycle for exceptionally unfavorable sequences of characters to be printed is more than compensated by the increase of the frequency of oscillation of the pushing member 18, resulting in an increase of the average printing speed.

Figure 9C:
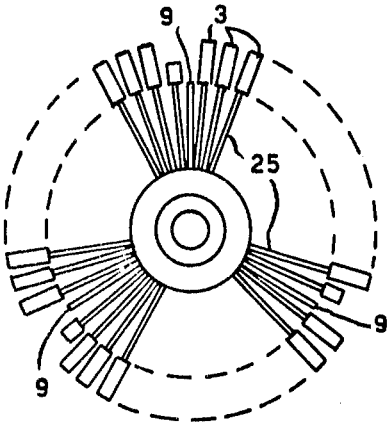

The same principle, of an intermediate stop on a rest position, can also be used without any translation of the printing wheel or deviation of the pushing member 18, by providing the printing wheel with three or more rest positions at substantially equal angular spacings with no printing characters, as indicated in FIG. 9*c*, instead of the one rest position of the wheel 1 of FIG. 5. In this way, in the most unfavourable search situations, there is always the possibility of encountering one rest position with no printing characters (9, FIG. 9*c*) on which to stop temporarily.

In another variant, the leaf springs of the printing wheel 1 are provided, in the side opposite the printing character 3, with a narrow extension protruding more than the printing run of the pushing member 18 and cooperating with the member. In this case the rest position of the printing wheel 1 may be any position half way between two printing positions of alignment of the printing characters with the pushing member 18. In such rest positions the pushing member 18 moves, passing between the backward extensions of two contiguous leaf springs, without influencing them. The angular displacement of a half character of the printing wheel 1 can be obtained by driving in a known way the positioning member 4, and requires no detailed description.

Figure 11:
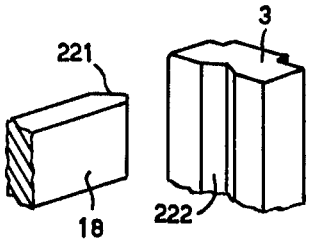
FIG. 11 represents another variant of the detail of FIG. 4.

Other variants are possible for the noiseless serial printer described. For instance, the alternate movement of the pushing member 18, instead of from an eccentric, can be obtained by means of a crank, or a cam mechanism, with substantially equivalent results. The pushing member 18 can also have the function of a precise positioner of the character 3 of the wheel 1 to be printed, as an example with the arrangement schematically indicated in FIG. 11, where said precise positioning is operated by a knife edge 221 on the extremity of the pushing member 18, that cooperates with a slot 222, having converging positioning surfaces, on the back of the printing character 3, or with an arrangement symmetrical to the one indicated, not shown in the drawings.

The typewriter described is of the synchronous type and its printing velocity of 15 characters per second is more than satisfactory for the requirements of manual input, with respect to the average input velocity, while the rollover capacity of 8 characters of the electronic keyboard 103 can easily take care of the instantaneous peaks in the input velocity. The same principle of noiseless printing can however be adopted also for asynchronous printing, without departing from the scope of the invention. In this case the printing operation without impact has to follow immediately after the end of the operation of search of the character to be printed.

The asynchronous printing is particularly useful if the printer is provided with input-output devices and used as a teleprinter of high velocity, or as a terminal for electronic data processing.

Figure 12:
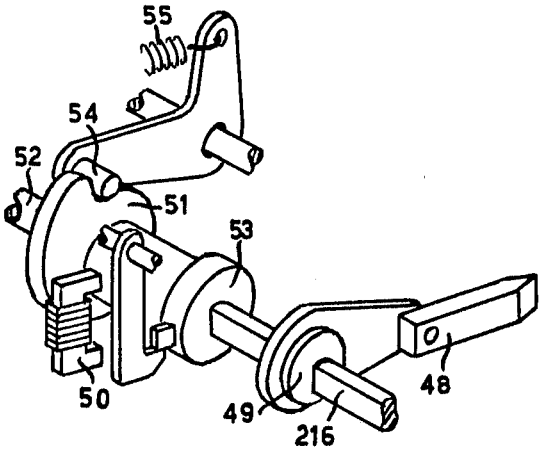
FIG. 12 represents another variant of the detail of FIG. 4.

One possible solution, schematically indicated in FIG. 12, consists of rendering intermittent the rotation of a grooved shaft 216 that determines the motion of a pushing member 48, by conditioning it through a clutch 53, instead of having it driven by the continuously rotating grooved shaft 16 as in FIG. 4. The velocity of rotation of the shaft 52 driving the clutch is higher than that of the grooved shaft 16 of FIG. 4 and in particular the grooved shaft 52 makes one full turn within a time O - Tr (FIG. 13) which is only slightly higher than the time T1–T4 of FIG. 6 with its rotating velocity in the order of 3,000 r.p.m. instead of the 900 r.p.m. of the grooved shaft 16. The overall run Sm (FIG. 13) of the pushing member 48 of FIG. 12 under the action of eccentric 49 is much shorter than that of the pushing member 18 of FIG. 4, and only slightly larger than the travel S1–S2 of the pushing member 18 in the time interval T1–T4 (FIG. 4).

In FIG. 12 the clutch 53 is released by an electromagnet 50, and is conditioned to open again at the end of each turn, by an opposing cam 51 cooperating with a roller 54, pushed by a spring 55. The actuation of the releasing electromagnet 50 is conditioned by the end of the search operation of the character to be printed, with a small anticipation accounting for the time of attraction of the electromagnet 50 and the closing time of the clutch 53.

At the end of each rotation of the driven member of the clutch 53, at the time Tg (FIG. 13) when the pushing member 48 leaves the printing character 3, a sensor similar to the already described sensor 122 of FIG. 1, generates an interrogation pulse, thus allowing for the immediate search of the following character to be printed, if one is present in the rollover memory of the keyboard encoder 103.

A similar result of asynchronous printing can also be obtained by substituting the eccentric type mechanism of FIG. 12 driving the pushing member 48 by an electromagnet device of the type indicated in FIG. 14, where a pushing member 58 acts on the printing character 3 of the printing wheel 1 in a way similar to the pushing members 18 and 48, of FIGS. 4 and 12.

The electromagnet 59 is of the movable coil type. The printing is without impact because, with respect to the electromagnet 5 with shoe 8 of FIG. 7, the moving coil electromagnet has a much lower moving mass, and its movement is rigidly controlled by a follow up system. In fact the movement of the pushing member 58, integral with moving coil 60 of the electromagnet 59, is controlled by a position sensor, schematically indicated in FIG. 14 by a photosensitive plate 61 collecting the light generated by a linear lamp 62. The light is partially intercepted by a shim 63, that follows the movement of the pushing member 58, so that the voltage generated by the photosensitive plate 61 is proportional to the run of said pushing member.

Many solutions are possible for the driving of the moving coil electromagnet 59, two of them are exemplified in the block diagram of FIGS. 15 and 16. The solution of FIG. 15 consists of duplicating for the pushing member 58, through the action of the moving coil 60, the law of movement impressed by the eccentric mechanism of FIG. 12 to the pushing member 48, and corresponding to the diagram of FIG. 13. To this end, the circuit of FIG. 15 includes a position follow up system, by means of the feedback between the photosensitive plate 61, sensing the position of the pushing member 58, and a circuit 64 driving the movable coil 60 of electromagnet 59, through resistors 73 and 74.

At the moment when the print is required, that is immediately after the positioning of the printing wheel 1 on the character to be printed, through a resistor 73 a driving pulse is applied to the driving circuit 64, of such an amplitude and shape to cause the movement of the moving coil 60 of the electromagnet 59 and of the pushing member 58 connected to it to correspond to the section O - $S_M$ of curve s of FIG. 13. The shape of the driving pulse, generated by a function generator 66, corresponds to that of the required displacement and the amplitude of the run of the pushing member 58 is determined by the amplitude of said driving pulse and by the ratio of resistors 73 and 74.

A more sophisticated circuit for driving the moving coil electromagnet 60 is indicated by the block diagram of FIG. 16, where a velocity follow up system is used instead of a position follow up. A capacitor 67 is provided in order to differentiate the feedback signal generated by the photosensitive plate 61 before applying it to the input of the driving circuit 64. The driving pulse generated by a function generator 69 (FIG. 16), is a square pulse, and is generated immediately after the end of the positioning of the printing wheel 1 (curve a, FIG. 17). When the pulse is received by the driving circuit 64 of the moving coil 60 of the electromagnet 59, said circuit impresses the maximum acceleration to the moving coil 60 and to the pushing member 58 integral with it, bringing them within a very short time Ta (FIG. 17) to a maximum displacement speed Vs limited by the feedback circuit, whose value is determined by the amplitude of the driving pulse a of FIG. 17, and by the time constant of the circuit comprising the capacitor 67 and the resistors 70 and 71 (FIG. 16), the value of Vs being so chosen that the run of the pushing member 58 takes place within a minimum time Tb (FIG. 17) compatible with no appreciable impact effects.

The circuit of FIG. 16 tends to maintain the velocity Vs constant as long as the driving pulse a (FIG. 17) is present, also when the pushing member 58, at the time Tb (FIG. 17), meets the printing character 3 and the paper sheet 11. At this moment, because of the feedback effect, the velocity drive becomes a pressure drive (curve p, FIG. 17) forcing to keep the speed Vs constant by applying the maximum force produced by the electromagnet 59 to the printing character 3, without impact, as long as pulse a is present.

A backwards driving pulse b (FIG. 17) is generated by the function generator 69 (FIG. 16) at the end of pulse a, with an opposite polarity, so as to cause the return of the pushing member 58 to the point of departure with a velocity Vr (FIG. 17). With respect to the circuit of FIG. 15, the circuit of FIG. 16 has the advantage that the printing pressure p applied to the paper sheet 11 is independent of the amplitude of the run of the pushing member 58, so allowing the elimination of any influence on the printing pressure of such factors as the thickness of the paper or the number of the copies or mechanical plays and tolerances, and the necessity of any regulation of the distance between the pushing member 58 and the paper 11.

Other variants are possible, following the known art, with respect to the solutions described, for driving the pushing member 58 by means of an electromagnet and it is equally possible to use different types of position sensing devices both analog and digital and, likewise, types of electromagnets different from the one described, without departing from the scope of the invention.

While preferred embodiments of the invention have been shown by way of example in the drawings, it will be understood that the invention is in no way limited to these embodiments.

What we claim is:

1. A serial printer for typewriters, teleprinters, and data processing output devices, comprising a printing head including a plurality of individual character carriers, each character carrier including a flexible leaf spring carrying a character substantially at the free end thereof, character selecting means for selectively moving said printing head to bring a selected one of said character carriers into alignment with a printing point, a paper supporting platen, a pushing member slidably movable to cause the selected character to engage the paper on said platen, a rotatable eccentric and moving means operable in a predetermined time relationship with said selecting means for rotating said eccentric, means for permanently connecting said eccentric to said pushing member to cause the latter to be positively reciprocated substantially according to an harmonic oscillatory motion having a pair of opposite dead points where the direction of motion is reversed, said pushing member, said selected character carrier and said platen being relatively disposed so that said pushing member engages said selected character carrier while said pushing member is decelerated by said eccentric and reaches one of said dead points of its said harmonic motion upon flexing the selected leaf spring and causing the selected character to penetrate a predetermined extent into said paper, whereby the printing is effected substantially through a pressure blow of the character.

2. A serial printer for typewriters, teleprinters, and data processing output devices, comprising a daisy printing wheel including a plurality of flexible leaf springs each carrying a character substantially at the free end thereof, character selecting means for selectively rotating said printing wheel to bring a selected one of said characters into alignment with a printing point, a paper supporting platen, a pushing member slidably movable to cause the selected character to engage the paper on said platen, a rotatable eccentric and moving means operable in a predetermined time relationship with said selecting means for rotating said eccentric, means for permanently connecting said eccentric to said pushing member to cause the latter to be positively reciprocated substantially according to an harmonic oscillatory motion having a pair of opposite dead points where the direction of motion is reversed, said pushing member, said printing wheel and said platen being relatively disposed so that said pushing member engages the leaf spring carrying said selected character while said pushing member is decelerated by said eccentric and reaches one of said dead points of its said harmonic motion upon flexing the engaged leaf spring and causing the selected character to penetrate a predetermined extent into said paper, whereby the printing is effected substantially through a pressure blow of the character.

3. A serial printer for typewriters, teleprinters and data processing output devices, comprising a printing wheel including a plurality of flexible leaf springs each carrying a character substantially at the free end thereof, character selecting means for selectively rotating said printing wheel to bring a selected one of said characters into alignment with a printing point, a paper supporting platen, a pushing member slidably movable to cause the selected character to engage the paper on said platen, a continuously rotating eccentric, means for connecting said eccentric to said pushing member to cause the latter to be positively reciprocated substantially according to an harmonic oscillatory motion having a pair of opposite dead points where the direction of motion is reversed, said pushing member, said printing wheel and said platen being relatively disposed so that said pushing member engages the leaf spring carrying said selected character while said pushing member is decelerated by said eccentric and reaches one of said dead points of said harmonic motion upon flexing the engaged leaf spring and causing the selected character to penetrate a predetermined extent into the paper, said selecting means being cyclically operable in predetermined time relationship with said harmonic oscillatory motion to move said printing wheel from any angular position to a selected angular position, said printing wheel being provided at a rest position with a portion devoid of characters and comprising input means selectively operable to cause said selecting means to rotate said printing wheel to the selected angular position corresponding to the character to be printed, said selecting means normally locating said printing wheel from any angular position to said rest position where said portion devoid of characters is located in alignment with said pushing member, when not caused to rotate by said input means, whereby when the input means is not operated said pushing member does not engage and print any characters.

4. A serial printer according to claim 3, wherein said portion devoid of characters includes more than one leaf spring devoid of characters and located at substantially equiangularly spaced rest positions of said printing wheel, said selecting means being operable to select a character in a variable number of cycles, according to the distance between two subsequently selected characters, said printing wheel temporarily stopping at the rest position located between said two selected characters.

5. A serial printer according to claim 3, comprising spacing means operable synchronously with said eccentric circular cam for relatively transversely displacing said platen with respect to said printing wheel for causing a character spacing upon printing each character, and a space between words.

6. A serial printer according to claim 5, wherein said input means comprises an input memory for storing a plurality of codes corresponding to a sequence of characters to be printed, sensing means for sensing the movement of said pushing member upon printing one of said characters, and control means responsive to said sensing means for generating an interrogation signal when said pushing member is removed from said printing wheel, said interrogation signal causing the stored code next following the code of the printed character to cause said selecting means to selectively rotate said printing wheel.

7. A serial printer according to claim 5, wherein said input means comprises an alphanumeric keyboard having a set of typing keys each one operable to control said selecting means and said spacing means, and a space bar operable to control said spacing means.

8. A serial printer according to claim 7, wherein said keyboard is of the electronic type wherein each key is depressible to generate a signal code corresponding to the character to be printed, and wherein said input means also comprises a rollover memory for storing at least two codes so generated, means for sequentially causing the codes stored in said rollover memory to control said selection means and said spacing means, sensing means for sensing the movement of said pushing member upon printing one of said characters, and control means responsive to said sensing means for generating an interrogation signal when said pushing member is removed from said printing wheel, said interrogation signal causing the stored code next following the code of the printed character to cause said selecting means to selectively rotate said printing wheel.

9. A serial printer for typewriters, teleprinters, and data processing output devices, comprising a daisy printing wheel including a plurality of flexible leaf springs, each carrying a character substantially at the free end thereof, character selecting means for selectively rotating said printing wheel to bring a selected one of said characters into alignment with a printing point, a paper supporting platen, a pushing member movable to cause the selected character to engage the paper on said platen, and a power electromagnet energizable for moving said pushing member toward the selected leaf spring and character, a power amplifier for energizing said electromagnet, a function generator for generating a substantially sinusoidal electric signal in predetermined time relationship with said selecting means, and a feedback circuit controlled by the movement of said pushing member and by said signal for controlling said power amplifier, whereby said pushing member is moved with an oscillatory motion law according to the amplitude of said signal, said motion including a pair of opposite dead points where the direction of motion is reversed, said pushing member, said printing wheel and said platen being relatively disposed so that said pushing member engages the leaf spring carrying said selected character while said pushing member is decelerated by said electromagnet and reaches one of said dead points of its said motion upon flexing the engaged leaf spring and causing the selected character to penetrate a predetermined extent into said paper, whereby the printing is effected substantially through a pressure blow of the character.

10. A serial printer according to claim 9, further comprising in combination as electronic keyboard, a rollover memory of the capacity of at least two characters, and means controlled by the end of said signal for causing the next following character stored in said rollover memory to condition said selecting means.

11. A serial printer according to claim 9, wherein said feedback circuit is responsive to the velocity of said pushing member.

12. A serial printer according to claim 11, wherein said power electromagnet is of the moving coil type.

* * * * *